United States Patent [19]

Tambara et al.

[11] 4,216,920

[45] Aug. 12, 1980

[54] TURRET TYPE YARN WINDING APPARATUS

[75] Inventors: Nobuhiko Tambara, Ishikawa; Katsumi Hasegawa, Kusatsu; Toshio Yasuda, Shiga, all of Japan

[73] Assignee: Toray Industries, Inc., Tokyo, Japan

[21] Appl. No.: 15,001

[22] Filed: Feb. 26, 1979

[30] Foreign Application Priority Data

Feb. 28, 1978 [JP] Japan ..... 53-21536

[51] Int. Cl.[3] ..... B65H 54/02; B65H 67/04

[52] U.S. Cl. ..... 242/18 A; 242/18 PW

[58] Field of Search ..... 242/18 A, 18 PW, 25 A

[56] References Cited

U.S. PATENT DOCUMENTS

| | | | |
|---|---|---|---|
| 3,310,247 | 3/1967 | Emery | 242/18 A |
| 3,708,133 | 1/1973 | McErlane et al. | 242/18 A |
| 3,717,310 | 2/1973 | Ritter | 242/18 A |
| 3,856,222 | 12/1974 | Wust | 242/18 A |
| 3,999,715 | 12/1976 | Schippers et al. | 242/18 A |
| 4,002,307 | 1/1977 | Turk et al. | 242/18 A |
| 4,033,519 | 7/1977 | Abe et al. | 242/18 A |

FOREIGN PATENT DOCUMENTS 2118147 10/1972 Fed. Rep. of Germany ..... 242/18 A

*Primary Examiner*—Stanley N. Gilreath

*Attorney, Agent, or Firm*—Miller & Prestia

[57] ABSTRACT

An improved turret type yarn winding apparatus provided with means for regulating a running yarn passage when the bobbin change operation is carried out. This yarn passage regulating means is capable of utilizing for the conventional turret type yarn winding apparatus. When the full size yarn package is displaced from the winding position to the stand-by position while a fresh bobbin is displaced to the stand-by position to the winding position, the running yarn is firstly shifted to a position outside the traverse motion of the traverse mechanism, and thus shifted running yarn is forced to pass along a predetermined yarn passage maintained by the above-mentioned yarn passage regulating means so that the running yarn can be assuredly caught by a yarn catching means rotated together with the spindle whereon a fresh bobbin is mounted, at the winding position.

12 Claims, 21 Drawing Figures

TURRET TYPE YARN WINDING APPARATUS

BACKGROUND OF THE INVENTION

1. Field of the Invention

This invention relates to an improved turret type yarn winding apparatus provided with a rotatable turret such as a turret disc or turret arm, whereon a pair of spindles are rotatably mounted for winding a continuously fed yarn on bobbins mounted on the respective spindles alternately.

2. Description of the Prior Art

In a conventional turret type yarn winding apparatus, for example, one disclosed in the specification of U.S. Pat. No. 4,033,519, a pair of spindles, on each of which a bobbin is mounted, are disposed on a turret at positions symmetrical with each other with respect to the rotation axis of the turret, and a yarn shifting guide and a guide for forming bunch winds are disposed on a winding device for winding a yarn on a bobbin mounted to the spindle located at a predetermined winding position while the yarn is being traversed by a traverse device. In this apparatus, the yarn-transfer from one bobbin to another is carried out in the following manner.

A full size yarn package formed on the bobbin mounted to the spindle located at the winding position is shifted to a stand-by position by turning the turret, while a fresh bobbin mounted on the other spindle located at the stand-by position is displaced to the winding position. A guide for forming bunch winds is projected along the axis of the spindle, and simultaneously, a yarn shifting guide standing by on the free end side of the spindle and on the upstream yarn feed side of the traverse device is moved toward the turret in parallel with the axis of the spindle. Thus, the yarn being fed is displaced from the traverse region of the traverse device toward the outside thereof and, consequently, the yarn is displaced toward a blade cut or groove formed outwardly of the winding-width of a fresh bobbin mounted on the spindle which has been transferred to the winding position by the above-mentioned rotation of the turret. Then, the feeding yarn is caught on the blade cut or groove, and the yarn is stretched between the caught portion and the full size yarn package, and is finally cut to stop supply of the yarn to the full size yarn package, and simultaneously, start winding of the yarn on the fresh bobbin. After passage of a predetermined period of time, the yarn shifting guide is returned to its original position. At this point, the yarn being fed is caught by a yarn guide of the traverse device, and then, the yarn is wound on the predetermined winding position of the bobbin to form a yarn package. The above-mentioned guide for forming bunch winds is disposed so that when the fed yarn is displaced outside the traverse range by the yarn shifting guide, the yarn is prevented from coming to a position outside the winding-width of the package.

In the conventional technique, the yarn-transfer from one bobbin to another at the time of exchange of bobbins is accomplished in the above-mentioned manner. This conventional technique, however, is defective in that the ratio of success in catching the yarn end on the blade cut or groove of a fresh bobbin is low. As a result of investigations conducted to clarify the cause of this defect, it was found that, since the running direction of the yarn having contact with the bobbin is not in agreement with the direction of the blade cut formed on the bobbin and both the directions intersect each other, even if the yarn is shifted to the position of the blade cut, it is difficult to engage and catch the shifted yarn on the blade cut. According to the conventional technique, the time for the yarn shifting operation by the yarn shifting guide is inevitably prolonged and, therefore, bunch winds are excessively formed on the yarn package. Accordingly, there is brought about another defect that, when packages are delivered, these accumlated yarns created by the above-mentioned excessive bunch winds must be removed.

SUMMARY OF THE INVENTION

It is a primary object of this invention to provide a yarn winding apparatus in which the above-mentioned defects and disadvantages of the conventional winding apparatus can be substantially eliminated and the ratio of success in transferring a yarn from a yarn package formed on a bobbin to a fresh bobbin can be remarkably increased by applying a simple structure.

In accordance with this invention, this object can be attained by the following improvement applied to a turret type yarn winding apparatus comprising a turnable turret on which a plurality of spindles for holding the respective bobbin are rotatably mounted, means for rotating spindles, a traverse mechanism for traversing a feeding yarn upstream of the spindle in an axial direction thereof, means for turning the turret to alternately exchange the positions of bobbins held by the spindles between a winding position and a stand-by position, that is, the above-mentioned improvement comprises, in combination, a yarn shifting guide for shifting a running yarn fed to a yarn package along a longitudinal axis of the spindle with a range through both positions outside and inside a range of traverse motion of the traverse mechanism, yarn catching means which is rotatable together with each of the spindle(s) and means for regulating yarn passage of the running yarn between the yarn shifting guide and the yarn package after the yarn package is moved from the winding position, to form a predetermined yarn passage comprising an upstream portion under the yarn shifting guide, an intermediate portion and a downstream portion between a downstream terminal of the intermediate portion and the yarn package, the upstream portion located at a position where the yarn catching means is capable of catching the above-mentioned running yarn, the downstream terminal of the intermediate portion located at a position within a range of a traverse motion of the traverse mechanism.

When the turret type yarn winding apparatus having the above-mentioned structure is employed, there can be attained an excellent effect that at the time of transferring a yarn from a full packaged bobbin to a fresh bobbin, the yarn can be instantaneously and assuredly caught and held by a blade cut or groove fromed on the bobbin or spindle, and the yarn transferring operation can be performed very stably at a very high success ratio.

BRIEF DESCRIPTION OF THE DRAWING

FIGS. 10A and 10C are schematic side views of a third embodiment of the turret type yarn winding apparatus according to the present invention, while

FIGS. 12A and 12C are schematic side views of the main part of the fourth embodiment of the turret type yarn winding apparatus according to the present invention, while

DETAILED DESCRIPTION OF THE PREFERRED EMBODIMENTS

The structure and functional effect of the turret type yarn winding apparatus of this invention will now be described by reference to embodiments illustrated in the accompanying drawings.

Figure 1:
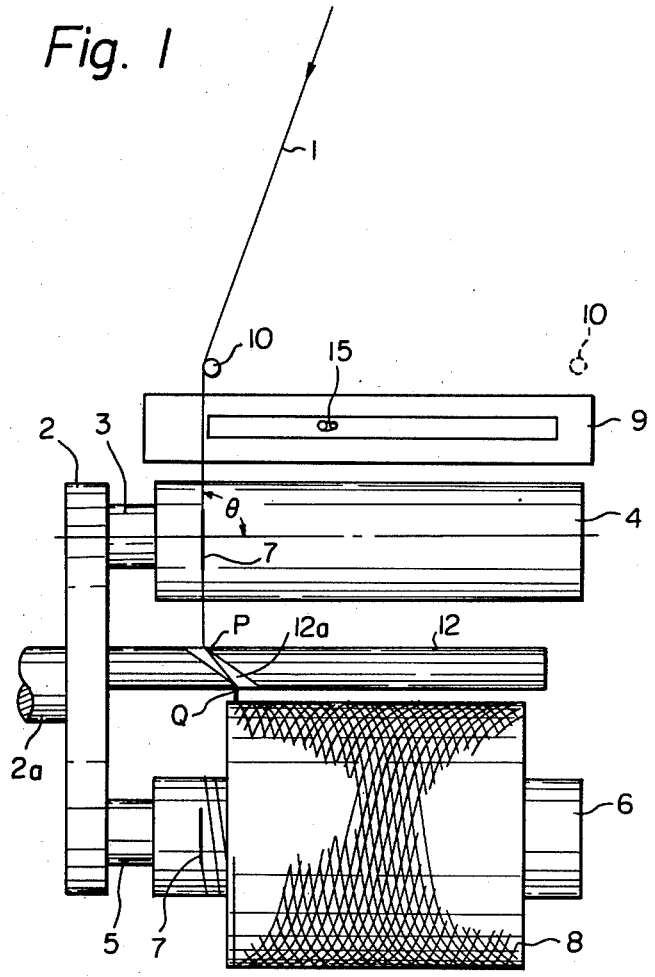
FIG. 1 is a schematic front view of the main part of the turret type yarn winding apparatus according to the present invention.

Referring to FIG. 1 illustrating one embodiment of the winding apparatus of this invention, spindles 3 and 5, for holding respective bobbins 4 and 6, are rotatably mounted on a turret disc 2 of the winding apparatus. This winding apparatus further comprises a traverse mechanism 9, and a yarn is wound on the bobbin 4 or 6 mounted on the respective spindle positioned at its winding position, while it is traversed by this traverse mechanism 9. Those spindles 3, 5 are driven by a driving mechanism (not shown) disposed to the turret 2 like the conventional apparatus. A yarn shifting guide 10 for shifting the yarn along the longitudinal direction of the traverse mechanism is mounted on the winding apparatus. A pneumatic cylinder (not shown) is used for displacing the yarn shifting guide 10. Since such mechanism is well-known in the prior arts such as U.S. Pat. No. 4,033,519, the detailed explanation thereof is omitted. Incidentally, a touch roller is disposed below the traverse mechanism 9, but such roller means is not illustrated in FIG. 1.

A pair of rod-like, yarn regulating guides 12 projecting from the turret in parallel to the spindle axis are arranged a positions symmetrical with each other with respect to the axis of the turret, and the secured positions of these yarn regulating guides 12 are downstream of the positions of the corresponding spindles with respect to the rotational direction of the turret. An oblique groove 12*a*, which will be described hereinafter in detail, is formed on each of the rod-like regulating guides 12. This oblique groove 12*a* is characterized by two edges P and Q. The edges P and Q function in such a manner that, when a running yarn 1 fed to a full size yarn package 8 is shifted toward the turret disc 2, the running yarn 1 shifting toward the turret disc 2 is caught by the edge Q so that further shifting of the running yarn 1 beyond the edge Q is prevented. When the shifting motion of the yarn 1 is stopped by the edge Q, the running yarn 1 is introduced into the groove 12*a* when the portion of the running yarn 1 upstream of the edge Q is shifted toward the turret disc 2 by the motion of the shifting guide 10. Once the running yarn 1 is introduced into the groove 12*a*, the edge P prevents the escape of the running yarn 1 from the groove 12*a*, in other words, the edge P defines the yarn passage between the shifting guide 10 and the edge P. In the above-mentioned condition, the yarn passage between the shifting guide 10 and the edge P is formed on an imaginary plane which intersects the longitudinal axis of the spindle 3 at a right angle in such a condition that the above-mentioned yarn passage passes over a blade cut 7 formed on the fresh bobbin 4. Therefore, if the running yarn 1 passes over the fresh bobbin 4 in a contacting condition therewith, the yarn 1 is easily caught by the blade cut 7. Incidentally, as pointed out hereinbefore, the touch roller is omitted in the drawing.

In the winding apparatus having the above-mentioned structure, the operation of shifting the yarn from one bobbin to another is performed in the following manner. By rotating the turret disc 2, the package 8 located at the winding position for winding the yarn thereon is shifted to the stand-by position and the yarn shifting guide 10 standing by on the right side in the drawing is shifted to the left. At this point, the running yarn 1 is allowed to fall into the oblique groove 12*a* of the yarn regulating guide 12 and, simultaneously, the yarn from the shifting guide 10 is led into the blade cut 7 of a fresh bobbin. (FIG. 1 illustrates the state just after the yarn 1 has been led into the blade cut 7.) When the yarn 1 is led into the blade cut 7, the yarn 1 is caught in the blade cut 7 and held thereby, and the yarn is cut between the caught portion on the fresh bobbin and the package 8. Accordingly, the yarn which has been wound on the package 8 is transferred from the package 8 to the fresh bobbin 4 and, consequently, the yarn can be wound thereon. During this bobbin change operation the yarn shifting guide 10 is shifted to a position close to a plane which intersects the axis of the bobbin at a right angle at the position of the blade cut 7 of the fresh bobbin 4. Accordingly, the yarn 1 running between the yarn shifting guide 10 and yarn regulating guide 12 is displaced to the position of the blade cut on the fresh bobbin 4 and the angle $\theta$ formed between the yarn 1 and the axis of the fresh bobbin 4 becomes about 90°. The above-mentioned shifting motion of the shifting yarn guide 10 is carried out by utilizing a shifting mechanism (not shown), such as a pneumatic cylinder or an electric solenoid, and the timing of the above-mentioned shifting motion is controlled by actuating the shifting mechanism. The control of the actuation is carried out by means of a control device, such as a sequential control mechanism utilizing a combination of a plurality of limit switches (not shown) and relays (not shown). Since the control mechanism is not the subject matter of this present invention, and such combination of the constituents of the control mechanism can be designed easily by a person with normal skill in the art, a detailed explanation thereof is omitted.

In the above illustration, it has been simply stated that the yarn 1 is allowed to fall in the oblique groove 12*a* of the yarn regulating guide 12 by the movement of the yarn shifting guide 10. This feature will now be described in detail.

Figure 2:
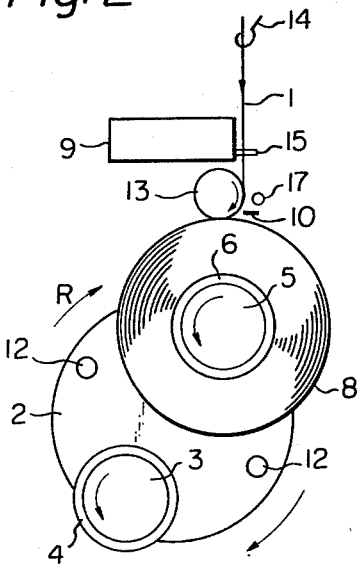
FIGS. 2, 3, 4 and 5 are schematic side views of the turret type yarn winding apparatus illustrated in FIG. 1, whereby the relative positions of the main machine elements during the operational steps for changing bobbins are illustrated.
Figure 3:
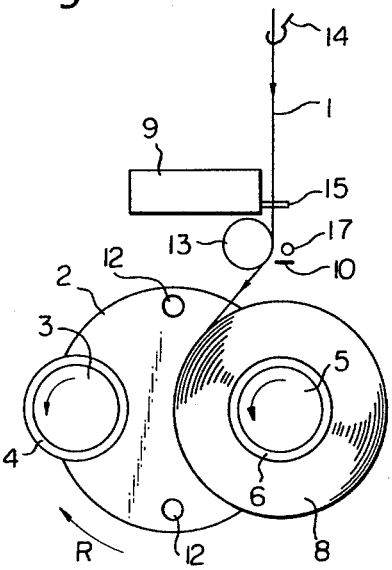
Figure 4:
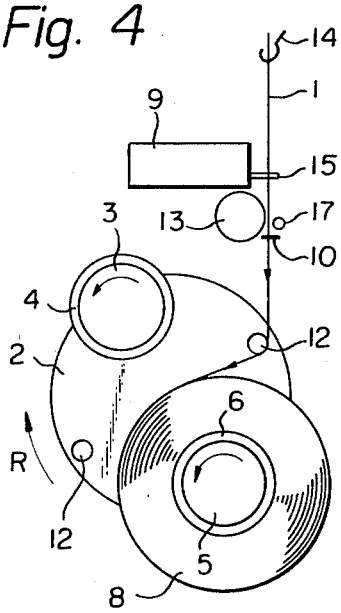
Figure 5:
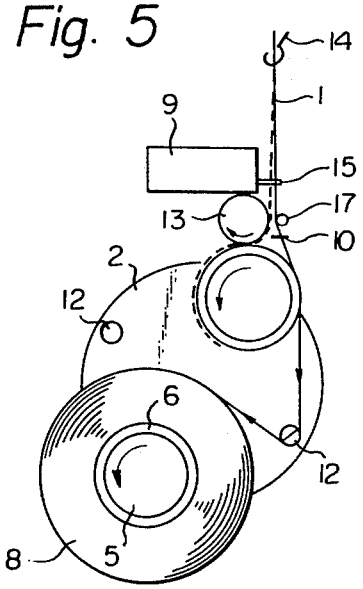
Figure 6:
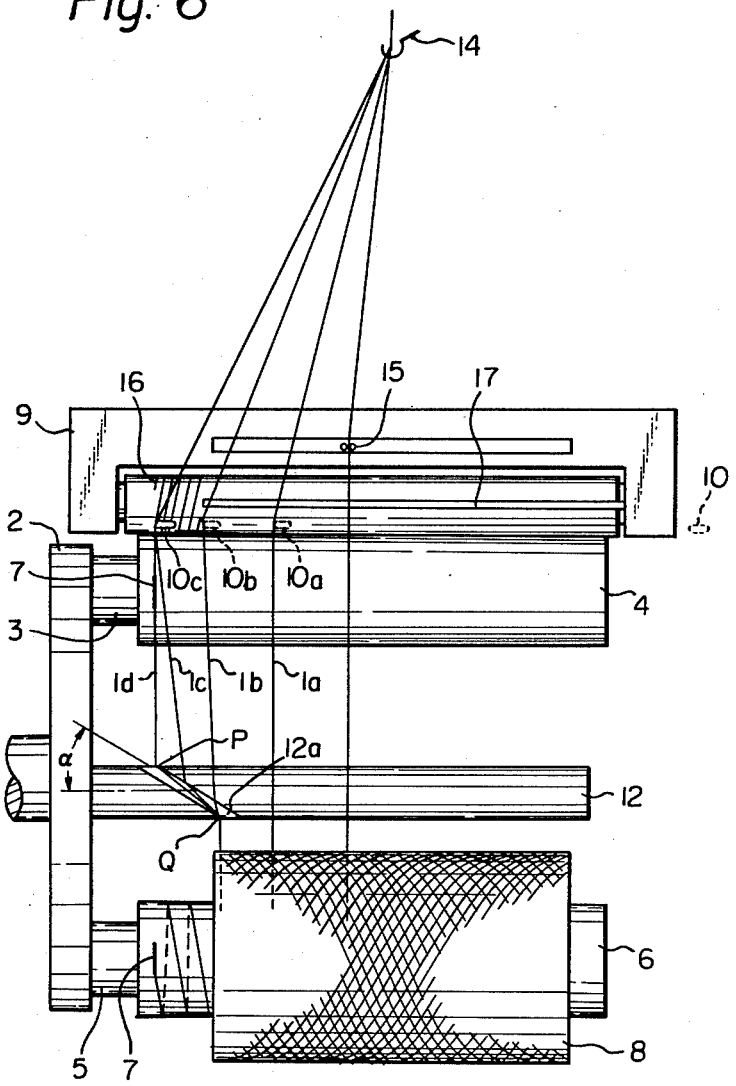
FIG. 6 is a schematic front view of the main part of the turret type yarn winding apparatus illustrated in FIG. 1, whereby the relative position of the main machine parts and a yarn passage between a full size yarn package and a yarn shifting guide at the time of changing bobbins is illustrated.

FIGS. 2 to 5 show the states in succession where a yarn 1 is being partially turned around the yarn regulating guide 12 while the package located on the winding position is displaced to the stand-by position. Referring to FIG. 2, a touch roller 13, which is not illustrated in FIG. 1, and a yarn press guide 17 are fixed to the traverse mechanism 9. The touch roller 13 is disposed to guide the yarn 1 running to the package 8 and apply a predetermined pressure to the package 8, and the yarn press guide 17 is disposed to prevent the yarn from coming off from a traverse guide 15 of the traverse mechanism 9 when the turret disc 2 is turnned at the time of transferring the yarn from the package 8 to the fresh bobbin 4 or 6. Even if this yarn press guide 17 is not mounted and the yarn 1 comes off from the traverse guide 15, the yarn is wound on the package 8 in the vicinity of the central portion thereof without being traversed and the yarn transferring operation can be performed without any trouble. The traverse mechanism 9, touch roller 13 and yarn press guide 17 are arranged so that they are integrally moved upwardly with the increase of the thickness of the package 8. Reference numeral 14 represents a traverse fulcrum guide, and other reference numerals represent the same members as in FIG. 1. When the yarn 1 is wound on the bobbin 6 mounted on the spindle 5 to form a package 8 as illustrated in FIG. 2 and a predetermined amount of the yarn is wound on the bobbin 6, the turret disc 2 is turned in a direction indicated by arrow R. The states where the turret disc 2 is turned in the direction R by 60°, 120° and 180° are shown in FIGS. 3, 4 and 5, respectively. As is seen from FIG. 5, when the turret disc 2 is turned by 180°, the position of the package 8 located at the winding position is exchanged with that of a fresh bobbin positioned at the stand-by position, and the running yarn 1 is partially turned around the yarn regulating guide 12 and then wound on the package 8 while being traversed by the tip end portion of the traverse guide 15. When the yarn 1 is held on the blade cut 7 and transferring of the yarn 1 is effected to start winding on the fresh bobbin 4, a yarn passage indicated by a dotted line in the drawing is formed. The state of FIG. 5 seen from the right is shown in FIG. 6. Referring to FIG. 6, when the yarn shifting guide 10 standing by on the right side of the yarn 1 being traversed by the traverse guide 15 is moved to the left, the yarn 1 is caused to come off from the traverse guide 15, and when the yarn shifting guide 10 is moved through points 10*a*, 10*b* and 10*c*, the yarn 1 is displaced as shown by 1A, 1B, 1C and 1D, and is finally allowed to fall in the oblique groove 12*a*. More specifically, the yarn first falls in the edge Q and is fixed at this edge. When the yarn shifting guide 10 is further moved to the left, a tension is applied to the yarn turned around the yarn regulating guide. Accordingly, the yarn is gradually introduced into the oblique groove 12*a* and finally arrives at the edge P. It is preferred that the inclination angle of the oblique groove, i.e., the angle between the oblique groove and the longitudinal axis of the yarn regulating guide, be large, especially at least about 45°.

When the yarn 1 is allowed to fall in the oblique groove 12*a* of the yarn regulating guide 12, the yarn 1 is caught and held by the blade cut 7 to effect transferring of the yarn from the package 8 to the fresh bobbin 4, and the yarn automatically comes off from the yarn shifting guide 10 and is then guided to a tail catching groove 16 of the touch roller 13 and then displaced to the predetermined winding position. Accordingly, a tail-wind without excess winding can be formed on the blade cut 7.

Figure 7:
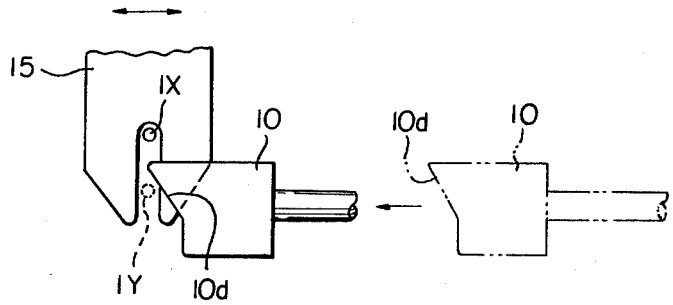
FIG. 7 is a plan view of a traverse guide and a yarn shifting guide of the turret type yarn winding apparatus illustrated in FIG. 1, whereby the relative position of those two guides is illustrated.

FIG. 7 illustrates the state where the yarn 1 comes off from the traverse guide 15 when the yarn shifting guide 10, which has stood by on the right side, is moved from its stand-by position (right side in FIG. 7) to the left. Referring to FIG. 7, 1X represents the position of the yarn when the yarn is wound at the winding position, and 1Y represents the position of the yarn when the package 8 is displaced to the stand-by position, as shown in FIG. 5, but still continues winding. If the yarn shifting guide 10 standing by on the right side is moved to the left when the yarn 1 is located at the position 1Y, an inclined portion 10*d* of the yarn shifting guide 10 pushes out the yarn 1 from the groove of the traverse guide 15. Accordingly, the yarn 1 can easily be moved away from the traverse guide 15.

Incidentally, when the yarn shifting guide 10 is moved to a position 10*c*, as shown in FIG. 6, the guide 10 stands still at this position for a while, but the yarn 1 is automatically moved away from the yarn shifting guide 10 because a passage as indicated by a dotted line in FIG. 5 is formed for the yarn 1 when the yarn 1 held by the blade cut 7 is wound on the fresh bobbin 4.

In the above described embodiment, the angle $\theta$ shown in FIG. 1 is adjusted to 90°. This angle $\theta$ may be changed to some extent depending on the configuration and number of the blade cuts or grooves 7 and may be slightly larger or smaller than 90°, as long as the success ratio of the yarn transferring operation is not substantially reduced.

Figure 8:
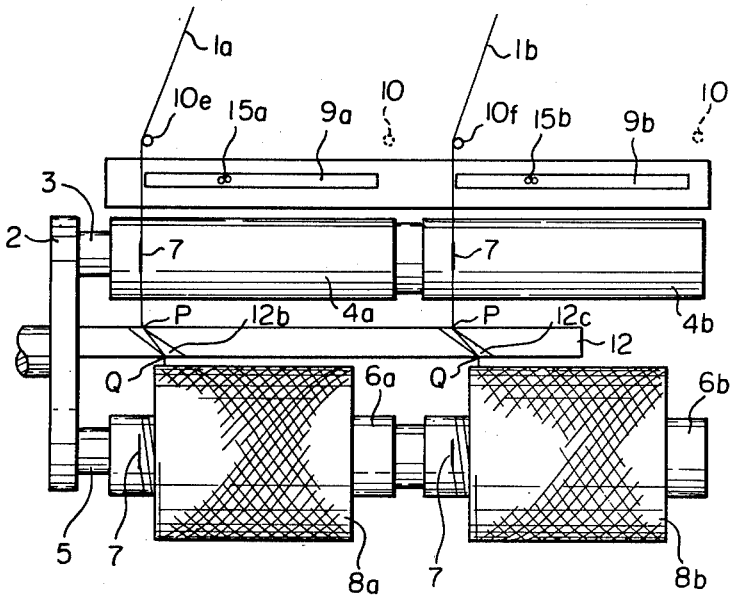
FIG. 8 is a schematic front view of the turret type yarn winding apparatus which is a modification of the winding apparatus illustrated in FIG. 1, wherein a pair of bobbins are mounted on each spindle so as to form two yarn packages simultaneously on the respective bobbins mounted on one of those spindles.

A modification of the turret type winding apparatus shown in FIG. 1 is illustrated in FIG. 8. In this embodiment, two winding bobbins 4*a* and 4*b* (or 6*a* and 6*b*) are mounted on each spindle with a very small distance therebetween, and two packages are simultaneously formed. A pair of traverse guides 15*a* and 15*b* are mounted on a traverse mechanism 9*a* and 9*b* to correspond to the bobbins 4*a* and 4*b* (or 6*a* and 6*b*), respectively. In this embodiment, yarn shifting guides 10*e* and 10*f* are disposed so that they simultaneously make predetermined movements (similar to the movement of the yarn shifting guide 10 in the first embodiment) correspondingly to the winding bobbins 4*a* and 4*b* (or 6*a* and 6*b*). Oblique grooves 12*b* and 12*c* similar to the oblique groove 12*a* of the yarn regulating guide 12 of the first embodiment are formed on the yarn regulating guide 12 so that the positional relationships between the oblique grooves 12*b* and 12*c* and the corresponding bobbins 4*a* and 4*b* (or 6*a* and 6*b*) are the same as the positional relationship between the oblique groove 12*a* and the bobbin 4 or 6 in the first embodiment. Accordingly, in the yarn winding apparatus shown in FIG. 8, the yarn transferring operation on each of the bobbins 4*a* and 4*b* (or 6*a* and 6*b*) is conducted in the same manner as in the yarn winding apparatus shown in FIG. 1.

Figures 9A, 9B, 9C:
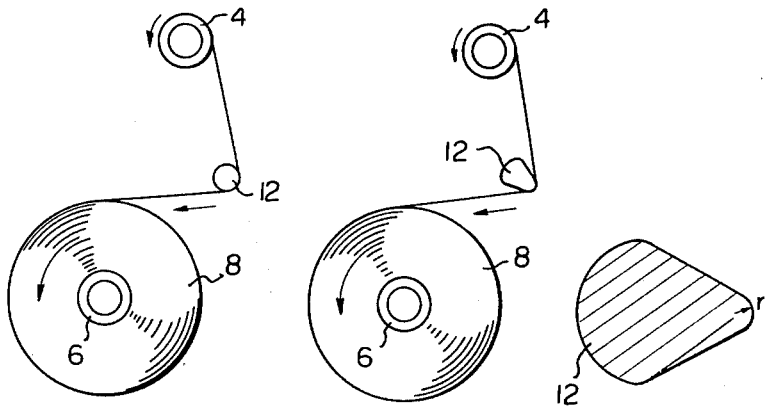
FIG. 9A is a schematic side view of a part of the winding apparatus illustrated in FIG. 1.
FIG. 9B is a schematic side view of a part of the winding apparatus, wherein the yarn regulating guide having a modified cross section is utilized.
FIG. 9C is an enlarged cross sectional side view of the yarn regulating guide illustrated in FIG. 9B.

In the above-described two embodiments, when the running yarn 1 (1*a*, 1*b* in FIG. 9.) is shifted to the blade cut 7 by the yarn shifting guide 10 (10*a*, 10*b*), the yarn slides while being pressed to the yarn regulating guide 12 located upstream of the full size yarn package 8 (8*a*, 8*b*) as shown in FIG. 8. Accordingly, the sliding speed of the yarn is lowered because of frictional contact of the yarn with the surface of the guide 12, and therefore, the timing of introducing the yarn 1 (1*a*, 1*b*) into the oblique groove 12*a* (12*b*, 12*c*) is retarded. Further, the yarn is damaged or split into filaments by such yarn shifting movement under frictional resistance. As a result, defective portions thus formed should be removed from the surface layer of the full size yarn package. In order to moderate or eliminate this disadvantage, it is preferred that the cross-section of the yarn regulating guide 12 not be circulr but be fan-shaped, so that the surface area of the yarn-contacting portion is made as small as possible. We conducted experiments on the winding apparatus as illustrated in FIGS. 9B and 9C. As a result, it has been confirmed that it is preferred, from a practical point of view, that the curvature radius r of the yarn-contacting portion of the fan-shaped cross-section of the guide 12 be 0.1 to 1.0 mm as seen from FIG. 9C.

A modification of the above-mentioned first and second embodiments is illustrated in the FIGS. 10A, 10B, 10C and 10D. In the turret type yarn winding apparatus shown in FIGS. 10A to 10D, a yarn is wound on a bobbin held on a spindle located at the winding position, and the resulting full size yarn package is doffed and a fresh bobbin held on another spindle is shifted to the winding position by 180° rotation of a turret arm 2*b*. At this point, for guiding the running yarn to a blade cut of a fresh bobbin 4, a yarn shifting guide 10 is moved from the stand-by position to the yarn displaced position correspoding to the blade cut 7 of the bobbin 4. In the winding apparatus shown in FIGS. 10A to 10D, there is adopted positive means for regulating the passage of the running yarn 1 during the above-mentioned yarn shifting step, on the side of the full size yarn package 8 held on the spindle 5 which has already been displaced to the stand-by position and shifting the passage of the running yarn 1 to the position correspoding to the blade cut 7 of the fresh bobbin 4.

This winding apparatus is different from the winding apparatuses of the above-described first and second embodiments in the point that the blade cut 7 of the bobbin is formed so that the blade cut 7 is located on the free end side of the spindles 3 and 5, respectively, on which the bobbin is mounted.

The yarn regulating guide having such a positive means for shifting the yarn passage as adopted in this embodiment and means for operating this yarn passage displacing means will now be described.

The turret type yarn winding apparatus of this embodiment, in which the above-mentioned positive yarn passage regulating means is adopted, has substantially the same function as that of the first or second embodiment. Mechanical elements which are the same as or similar to those of the first and second embodiments are indicated by the same reference numerals used in the first and second embodiments, and their explanations are omitted.

As pointed out above, this embodiment is characterized in that a yarn passage regulating means performing a positive action is utilized. For convenience, the construction and function of the yarn passage regulating means is first described by reference to FIGS. 10A through 10D, 11A and 11B.

In this embodiment, a turret arm 2*b* fixed to a rotation shaft 2*a* is used instead of the turret disc 2 used in the first and second embodiments. A pair of spindles 3 and 5 are disposed rotatably on the free end of the turret arm 2*b* symmetrically with each other with respect to the axis of the rotation shaft 2*a*, and bobbins 4 and 6 are mounted on these spindles 3 and 5, respectively. A yarn regulating guide 12 is fixed to the turret arm 2*b* at a position symmetrical with the axis of the rotation shaft 2*a*. Incidentally, this yarn regulating guide 12 is disposed in parallel to the spindles 3 and 5 and has an axis positioned on a plane which intersects a plane passing through the axes of both spindles 3 and 5. The turret arm 2*b* is arranged so that exchange of bobbins, that is, shifting of the yarn from one bobbin to another bobbin, is performed by a 180° rotation of the arm 2*b* in the clockwise direction in FIGS. 10A and 10C between the position indicated in FIGS. 10A and 10C and the other position where the positions of the spindles 3 and 5 are reversed from those shown in FIGS. 10A and 10C. In this point, function of the turret arm 2*b* of this embodiment is not different from the turret disc of the first and second embodiments. The position of the yarn regulating guide 12 located on the right side of the turret arm 2*b* in FIG. 10A will hereinafter the referred to as "yarn shifting position" for facility of explanation. A pneumatic operation cylinder 21 is disposed on an extension of the axis of the yarn regulating guide 12 at this yarn shifting position within a machine frame 20. As shown in FIGS. 10B, 10D, 11A and 11B, the yarn regulating guide 12 comprises a hollow guide 12*d* with a fan-shaped cross-section, a rod 12e slidably disposed in the hollow guide 12*d*, a disc 12f fixed to the free end of the rod 12*e* on the side of the machine frame 20, an expansion helical spring 23 mounted on the rod 12*e* between the end portion of the hollow guide 12*d* on the side of the machine frame 20 and the disc 12*f*, a slit 29 formed on the cylindrical guide 12*d* along the axis thereof in the vicinity of the position corresponding to the blade cut 7 of the bobbin, a recess 12*g* formed in the rod 12*e* at the position corresponding to the slit 29, a pawl 25 rotatably mounted on the wall face of the recess 12*g* through a pivot pin 24, a plate spring 27 having one end fixed to the lower portion of the recess 12*g* by a screw 28 and the other free end always pressing against the pawl 25 to always push up the pawl 25 toward the slit 29 around the pin 24, and a stopper 26 fixed to the side wall of the recess 12g to restrict the upward rotation of the pawl 25. A piston 22 of a pneumatic cylinder 21 is capable of projecting outwardly from an opening 20*a* formed on the machine frame 20. When the pneumatic cylinder 21 is operated, the piston 22 projects outwardly from the opening 20*a* and presses the disc 12*f* of the yarn regulating guide 12. Accordingly, the rod 12*e* is intruded into the cylindrical guide 12*d* toward the free end thereof against the resilient force of the spring 23. On the other hand, when the pneumatic cylinder 21 is further operated and the piston 22 is retreated into the machine frame 20, by the resilient force of the spring 23, the rod 12*e* is moved through the hollow guide 12*d* and returned to the stand-by position, as shown in FIG. 10B. Securing of the rod 12*e* at the above advance position and stand-by position is ensured by means of stoppers (not shown). On the free end side of the yarn regulating guide 12, a yarn passage restricting guide 30 is mounted on the side opposite to the slit 29 to prevent the fed yarn from coming off outwardly from the peripheral end portion of the package 8 formed on the bobbin 4 (or 6) during the yarn shifting step, that is, the bobbin exchange step.

In the present embodiment, the slit of the hollow guide 12*d*, the pawl 25 and yarn passage restricting guide 30 are arranged so that the following positional relationship is established.

The yarn passage restricting guide 30 is disposed at a position corresponding to the point Q of the oblique groove 12*a* of the first embodiment, and the point at which the advancing movement (the movement toward the free end side of the yarn regulating guide 12) of the rod 12*e* by the pneumatic cylinder 21 terminates corresponds to the position where the top end of the pawl is outwardly projected from the slit 29 and further advanced to shift the yarn 1 to the position corresponding to the point P of the oblique groove 12*a* in the first embodiment. An edge 12*h* of the hollow guide 12*d*, which defines the rearward terminal of the slit 29, works like a member for controlling the free turning motion of the pawl 25 about the pivot pin 24. That is, when the rod 12*e* moves toward the machine frame 20 (which is hereinafter referred to the retreating movement), the pawl 25 receives a force to cause it to sink into the interior of the hollow guide 12*d* by contact with the edge 12*h* of the guide 12*d*, and finally, comes into the hollow guide 12*d*. On the other hand, when the rod 12*e* moves toward a direction away from the machine frame 20 (which is hereinafter referred to the advancing movement), the edge 12*h* of the guide 12*d* prevents the possible free projecting motion beyond the slit 29. In order to shift the running yarn 1 to the above-mentioned point P assuredly, the position of the edge 12*h* is arranged in such a manner that, when the rod 12*e* carries out the advancing movement, at a position closer to the machine frame 20 than the passage of the yarn running through the yarn passage restricting guide 30 to the yarn package, the top end of the pawl 25 projects outwardly over the surface of the cylindrical guide 12*d* to a position where the pawl 25 can catch the yarn 1 more assuredly. In FIGS. 10A to 10D, reference numeral 31 represents a vertically moving bracket, holding the traverse mechanism 9, reference numeral 32 represents pillors for guiding the vertical movement of the bracket 31 and reference numeral 33 represents a guide for regulating the running yarn 1 so that it does not separate from the spindle located at the winding position.

The operations and effects of the third embodiment of the present invention will now be described by reference to FIGS. 10A through 10D and FIGS. 11A and 11B.

Figure 10A:
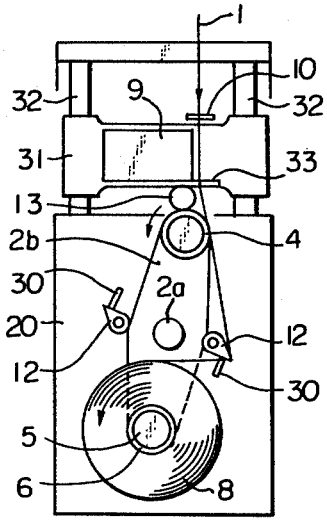
Figure 10B:
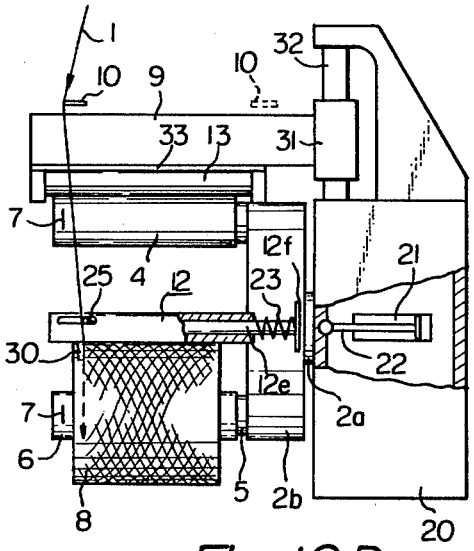
FIGS. 10B and 10D are schematic front views of the turret type yarn winding apparatus illustrated in FIGS. 10A and 10C, whereby the relative positions of the main machine parts at the time of carrying out the bobbin change are illustrated.

First Movement (FIGS. 10A and 10B)

When a full size yarn package 8 is formed on the bobbin 6, an actuator (not shown) is operated by a signal from a control device (not shown) to rotate the turret arm 2*b* by 180°. During this rotation or on completion of this rotation, the spindle 3 and the fresh bobbin 4 mounted thereon are shifted to the winding position. At tis point, the actuator (not shown) is operated by a signal from the above-mentioned control device (not shown) to move the yarn shifting guide 10 from the stand-by position (indicated by a dotted line in FIG. 10B) to the yarn shifting position (indicated by a solid line in FIG. 10A). According to the above-mentioned motion of the guide 10, the fed yarn 1 is separated from the yarn guide of the traverse mechanism 9 and shifted to the position shown in FIG. 10B.

Figure 11A:
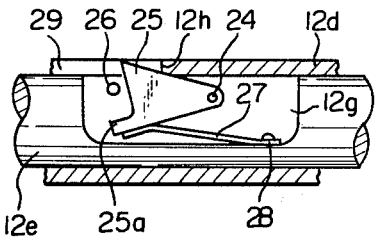
FIGS. 11A and 11B are a schematic front views partly in section, of the yarn regulating guide utilized for the third embodiment of the apparatus, as illustrated in FIGS. 10A, 10B, 10C and 10D, wherein the two relative positions of the main elements thereof are illustrated.
Figure 11B:
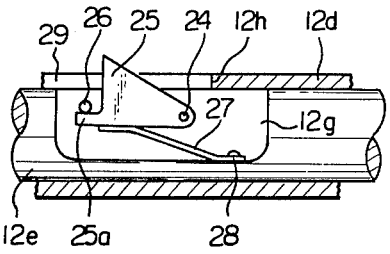

In the above-mentioned yarn shifting operation, the yarn 1 slides on the yarn regulating guide 12, that is the hollow guide 12*d* (FIGS. 11A, 11B), toward the free end thereof, but its position relative to the yarn package 8 is regulated by the yarn passage restricting guide 30 so that it does not come off from the end of the package 8. The passage of the fed yarn 1 is determined by the yarn shifting guide 10 and the yarn passage restricting guide 30, so that it runs while in contact with the end face of the bobbin 4, at a certain angle to the axial direction of the bobbin 4, and it reaches the package 8. When the running yarn 1 slides on the yarn regulating guide 12, that is the hollow guide 12*d*, (FIGS. 11A, 11B) toward the free end thereof, since the pawl 25 is confined in the hollow guide 12*d* as shown in FIG. 11A, it does not inhibit the sliding movement of the yarn 1 at all.

Figure 10C:
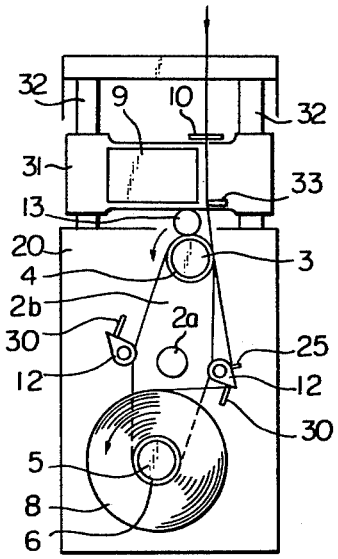
Figure 10D:
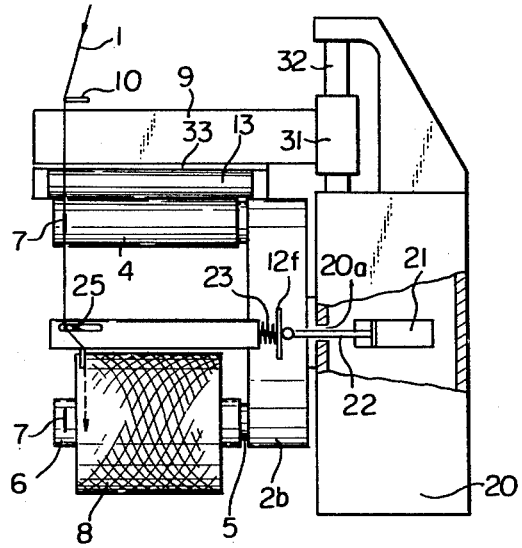

Second Movement (FIGS. 10C and 10D)

Then, by a signal from the above-mentioned control device (not shown), the pneumatic cylinder 21 is actuated to push out the piston 22. The piston 22 presses the disc 12*f* and, therefore, the rod 12*c* is caused to make the advancing movement. By the advancing movement of the rod 12*e*, as described hereinbefore, the pawl 25 projects outwardly from the slit 29 of the hollow guide 12*d* and further advances. At this point, the pawl 25 catches the yarn 1 and shifts the yarn 1 to the terminal point of the advancing movement of the rod 12*e*, that is, the point P in the first embodiment. By this yarn shifting motion, the yarn passage determined by the yarn shifting guide 10 and the top end of the pawl 25 is made parallel to the groove of the blade cut 7 of the fresh bobbin 4 and is aligned with this groove with respect to the axial direction of the bobbin. The yarn present downstream of the yarn passage restricting guide 30 is regulated by this guide 30 and is prevented from coming off from the end of the yarn package 8.

In this state, the yarn 1 is allowed to fall in and is engaged withe the groove of the blade cut 7 of the bobbin 4, and is caught and held assuredly by the bobbin 4. Then, the yarn 1 is stretched and cut between the bobbin 4 and the package 8 by the rotation of the spindle 3. Thus, shifting of the yarn to the fresh bobbin 4 is accomplished.

Third Movement

At this point of completion of transferring the yarn 1 to the fresh bobbin 4, the actuator is operated by a signal from the control device (not shown) to actuate the pneumatic cylinder 21 to retreat the piston 22 and initiate winding on the fresh bobbin 4. When the piston 22 is retreated, by the resilient force of the spring 23, the rod 12*e* is retreated to the side of the machine frame 20 as described hereinbefore, and by this retreating movement, the pawl 25 is intruded into the cylindrical guide 12*d* against the force of the plate spring 27. In this state, the pneumatic cylinder 21 is returned to the stand-by position.

As the control device used in the above-mentioned embodiment, there is preferably employed a control system compsising limit switches which are arranged cooperatively so that actuators for the respective mechanical elements are electrically operated at sequential timings. From a practical viewpoint, a known two-way changeover electromagnetic valve is preferred as the actuator for the hydraulic cylinder 21. As the moving means for the yarn shifting guide 10, a pneumatic cylinder is preferred from a practical viewpoint, as in the case of the yarn regulating guide.

Figure 12A:
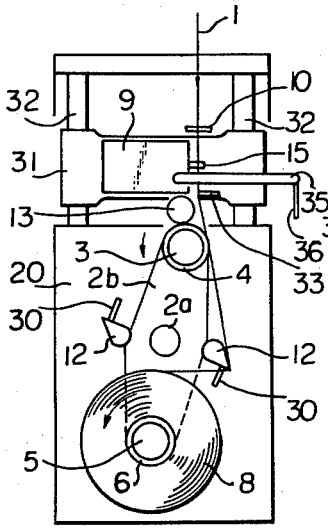
Figure 12B:
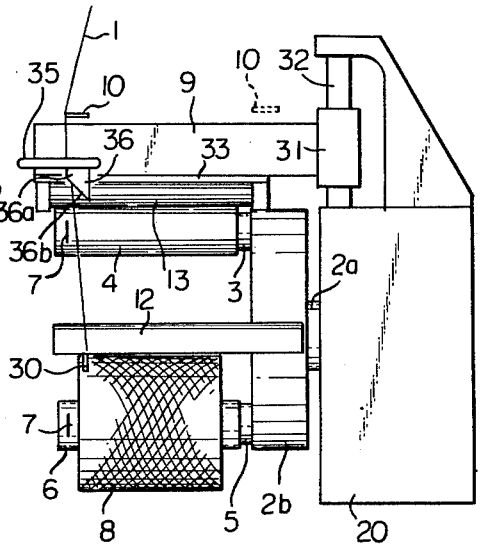
FIGS. 12B and 12D are schematic front views of the main part of the fourth embodiment of the present invention, whereby the relative positions of the main machine parts at the time of carrying out the bobbin change are illustrated.

The fourth embodiment of the turret type yarn winding apparatus according to the present invention is illustrated in FIGS. 12A, 12B, 12C and 12D. In this embodiment, the function and structure of the means for regulating the yarn passage in the above-mentioned third embodiment are modified, and only the yarn passage restricting guide 30 is disposed to the yarn regulating guide 12. As means for aligning the passage of the yarn 1 guided by the yarn shifting guide 10 and yarn passage restricting guide 30 with the blade cut 7 formed on the fresh bobbin, a second yarn shifting means is mounted on the bracket 31 of the traverse mechanism 9. This second yarn shifting means comprises an L-shaped arm 35 turnably mounted on the bracket 31 of the traverse mechanism 9 between the stand-by position and the operation position, a changeover guide 36 fixed to the end of the horizontal part of the L-shaped arm 35 and means for moving the L-shaped arm between the above-mentioned stand-by position and the operation position, for example, a rotary actuator (not shown). As shown in FIGS. 12A to 12D, the L-shaped arm 35 has a base portion connected to the horizontal portion. At the stand-by position, the L-shaped arm 35 is kept completely in the horizontal state, as shown in FIGS. 12A and 12B. The changeover guide 36 has a holding face **36*a* and a catching face 36*b*. When the L-shaped arm 35 is turned from the stand-by position, where it is kept completely in the horizontal state, to the lower operation position (see FIGS. 12C and 12D) by turning the base portion thereof downwardly, the catching face 36*b* catches the running yarn 1 guided by the yarn shifting guide 10 and yarn passage restricting guide 30, and; when the L-shaped arm 35 arrives at the operation position shown in FIGS. 12C and 12D, the holding face 36*a* holds the yarn 1 at the position corresponding to the point P of the oblique groove 12*a* formed on the yarn regulating guide 12** in the first embodiment.

Figure 12C:
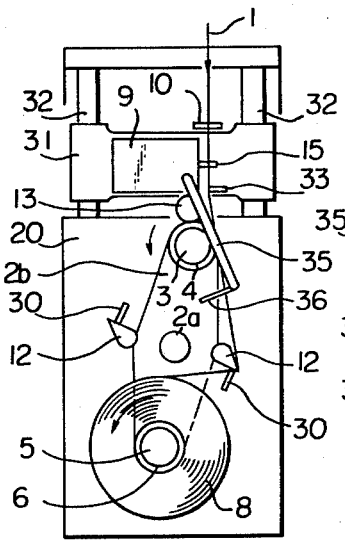
Figure 12D:
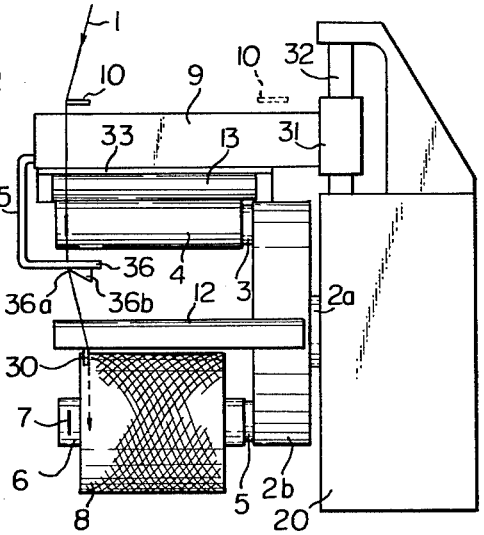

The operations of this embodiment are accomplished by three motions of the mechanical elements. The first motion is the same as the above-mentioned first movement of the third embodiment. Accordingly, explanation of this motion is omitted. The state of the respective mechanical elements during this first motion is as shown in FIGS. 12A and 12B. During the second motion, as shown in FIGS. 12C and 12D, the L-shaped arm 35 is downwardly turned, the yarn 1 is firstly forced to contact the catching face **36*b* of the changeover guide 36 and, according to the further turning motion of the L-shaped arm 35, the yarn 1 slides over the catching face 36*b* and comes to the holding face 36*a*. Consequently the yarn passage of the running yarn 1 guided by the yarn shifting guide 10 and the holding face 36*a* is introduced to the groove of the blade cut 7 formed on the spindle 4 in an engageable condition. Due to the further turning motion of the L-shaped arm 35, the running yarn 1 is urged to the bobbin 4 and, therefore, the yarn 1 is caught by the groove of the blade cut 7. Since tension is created between the catching position of the yarn 1 by the blade cut 7 and the full size yarn package 8 by the rotation of the spindles 3 and 5, the yarn 1 is cut at a position between the bobbin 4 and the full size yarn package 8, and the winding of the yarn 1 on the bobbin 4 is started. During the third motion, just after the shifting of the yarn from the full bobbin to the empty bobbin, the L-shaped arm 35 is returned to the stand-by position shown in FIGS. 12A and 12B, and simultaneously, the yarn shifting guide 10 is returned to the stand-by position indicated by a adotted line in FIGS. 12B and 12D, whereby the yarn 1 is engaged with the traverse guide 15 of the traverse mechanism 9 and normal winding of the yarn 1 on the bobbin 4** is started. The sequential timings of operations of the respective mechanical elements are controlled by the program control of actuators, by a control system including limit switches, in the same manner as in the third embodiment.

As will be apparent from the above illustration, according to this invention, since means for positively catching the yarn extending from the yarn shifting guide to the full size yarn package shifted to the stand-by position and holding this yarn in a yarn catching groove formed on the fresh bobbin or spindle located at the winding position is adopted as well as the yarn shifting guide, during the step of bobbin exchange, that is, the step of transferring the yarn from the full bobbin to the fresh bobbin, the yarn is assuredly caught and held by the fresh bobbin or spindle, and a very high success ratio of the yarn transferring operation can be attained very stably. This is a very excellent effect that cannot be attained by the conventional technique.

In each of the above-mentioned four embodiments, a pair of bobbin holding spindles are disposed symmetrically with each other (phase difference of 180°) with respect to the rotation axis of the turret disc or turret arm. In this invention, there may be adopted a modification in which three or four spindles are disposed with a phase difference of 120° or 90°. Means for regulating the yarn passage as used in the above-mentioned embodiments are mounted in parallel with these spindles, respectively, and the yarn transfer operation for exchange of bobbins is performed as in the above-mentioned embodiments. In the above-mentioned embodiments according to the present invention, the spindles disposed on the turret are positively driven, however, the present invention may be applied to a turret type winding apparatus wherein the spindle positioned at the winding position is driven by frictional contact with a rotating roller means. In this case the timing of the yarn transfer motion must be completed until the rotation of the full size yarn package displaced to the stand-by position due to the inertia thereof is stopped.

What is claimed is:

1. In a turret type yarn winding apparatus comprising a turnable turret on which a plurality of spindles for holding a respective bobbin are rotatably mounted, means for rotating said spindles, a traverse mechanism for traversing a feeding yarn upstream of said spindles in an axial direction thereof, means for turning said turret to alternately exchange the positions of bobbins held by said spindles between a winding position and a stand-by position, an improvement comprising, in combination, a yarn shifting guide for shifting a running yarn fed to a yarn package along a longitudinal axis of said spindle with a range through both positions outside and inside a range of traverse motion of said traverse mechanism, yarn catching means being rotatable together with said spindle, and means for regulating a yarn passage of said running yarn between said yarn shifting guide and said yarn package after said yarn package is moved from said winding position, to form a predetermined yarn passage comprising an upstream portion under said yarn shifting guide, an intermediate portion and a downstream portion between a downstream terminal of said intermediate portion and said yarn package, said upstream portion located at a position where said yarn catching means is capable of catching said yarn, said downstream terminal of said intermediate portion located at a position within a range of a traverse motion of said traverse mechanism.

2. An improved turret type yarn winding apparatus according to claim 1, wherein said means for regulating a yarn passage of said running yarn comprises a plurality of bar-like guide members secured to said turret in parallel condition to said spindles at symmetrical positions about a turning axis of said turret in a condition of forming a set by one of the bar-like guide members and one of said spindles, and a pair of guide elements disposed on each of said bar-like guide members, a first one of said yarn guide elements defining said downstream terminal of said intermediate portion of said predetermined yarn passage, a second one of said yarn guide elements defining a downstream terminal of said upstream portion of said predetermined yarn passage at a position outside the range of said traverse motion of said traverse mechanism, whereby said upstream portion of said predetermined yarn passage is located on an imaginary plane perpendicular to the longitudinal axis of said spindles, said imaginary plane passing said yarn catching means located at a position outside the range of the traverse motion of said traverse mechanism.

3. An improved turret type yarn winding apparatus according to claim 2, wherein said bar-like guide member is provided with an oblique groove formed at a position in the proximity of a yarn passage defined by a terminal of traverse motion of said traverse mechanism, a pair of guide walls being defined by said oblique groove, an upstream terminal of said groove being located at a position outside the range of traverse motion of said traverse mechanism, while a downstream terminal of said groove is located at a position inside the range of traverse motion of said traverse mechanism, an upstream terminal of said guide wall located at a side of the center of said traverse motion serving as said second yarn guide element, while a downstream terminal of the other guide wall serves as said first yarn guide element.

4. An improved turret type yarn winding apparatus according to claim 3, wherein said oblique groove has an inclined angle to the longitudinal axis of said bar-like guide member larger than 45° in the first quadrant of the intersecting of the central line of said groove and said longitudinal axis of said bar-like guide member.

5. An improved turret type yarn winding apparatus according to claim 2, wherein said means for regulating a yarn passage of said running yarn comprises a plurality of hollow guide members secured to said turret in a parallel condition to said spindles at symmetrical positions about a turning axis of said turret in a condition of forming a set by one of said hollow guide members and one of said spindles, a pair of yarn guide elements disposed on each of said hollow guide members, each of said hollow guide members being provided with a slit, a first one of said yarn guide elements being secured to said hollow guide member and defining said downstream terminal of said intermediate portion of said predetermined yarn passage, a second one of said yarn guide elements being disposed in said hollow guide member in such condition that said second yarn guide element is capable of displacing along the axis of said hollow guide member and also capable of projecting outward from said slit to catch said running yarn according to the displacement thereof, and means for displacing and projecting said second yarn guide element outside said hollow guide member, said second yarn guide element defining said downstream terminal of said upstream portion of said predetermined yarn passage at the terminal of the motion of said displacing and projecting means.

6. An improved turret type yarn winding apparatus according to claim 2, wherein said bar-like guide member is provided with a longitudinal edge portion formed along the lengthwise direction thereof, said edge portion guiding said running yarn when the transfer motion of said running yarn from a full size yarn package to a fresh bobbin located at a winding position is carried out.

7. An improved turret type yarn winding apparatus according to claim 6, wherein a cross-section of said bar-like guide member has a small arch like profile having a radius in a range between 0.1 and 1 mm which profile corresponds to said edge portion.

8. An improved turret type yarn winding apparatus according to claim 1, wherein said yarn catching means is a blade cut formed at an end portion of each bobbin at the portion for forming a tail winding when said bobbin is mounted on each of said spindles, said blade cut being located on an imaginary plane perpendicularly intersecting a longitudinal axis of said bobbin.

9. An improved turret type yarn winding apparatus according to claim 1, wherein said means for regulating a yarn passage of said running yarn comprises a plurality of bar-like guide members secured to said turret in parallel condition to said spindles at symmetrical positions about a turning axis of said turret in a condition of forming a set by one of said bar-like guide members and one of said spindles, a L-shaped guide rod provided with a base portion and a tip portion turnably mounted at a position where a running yarn can be caught when said yarn shifting guide shifts said running yarn outside the traverse motion of said traverse mechanism, means for turning said L-shaped lever, a yarn passage restricting guide secured to said bar-like guide member at a position corresponding to said downstream terminal of said predetermined yarn passage, said L-shaped lever being provided with a changeover guide at a portion of said tip portion thereof, said changeover guide defining said downstream terminal of said upstream portion of said predetermined yarn passage when said L-shaped lever is turned to a position corresponding to the terminal of the turning motion thereof.

10. An improved turret type yarn winding apparatus according to claim 9, wherein said bar-like guide member is provided with a longitudinal edge portion formed along the lengthwise direction thereof, said edge portion guiding said running yarn when the transfer motion of said running yarn from a full size yarn package to a fresh bobbin located at a winding position is carried out.

11. An improved turret type yarn winding apparatus according to claim 10, wherein a cross-section of said bar-like guide member has a small arch like profile having a radius in a range between 0.1 and 1 mm, which profile corresponds to said edge portion.

12. An improved turret type yarn winding apparatus according to claim 9, wherein said yarn catching means is a balde cut formed at an end portion of each bobbin at the portion for forming a tail winding when said bobbin is mounted on each of said spindles, said blade cut being located on an imaginary plane perpendicularly intersecting a longitudinal axis of said bobbin.

* * * * *